United States Patent [19]

Schnell

[11] 4,455,020

[45] Jun. 19, 1984

[54] ROTATABLE HANDHOLD FOR ATHLETIC EQUIPMENT ESPECIALLY FOR BARBELLS

[76] Inventor: Josef Schnell, Sportweg 9, 8899 Peutenhausen, Fed. Rep. of Germany

[21] Appl. No.: 356,250

[22] Filed: Mar. 8, 1982

[30] Foreign Application Priority Data

Mar. 9, 1981 [DE] Fed. Rep. of Germany ..... 3108830

[51] Int. Cl.[3] ..... A63B 13/00

[52] U.S. Cl. ..... 272/123

[58] Field of Search ..... 272/122, 123; 145/61 EA; 15/143 R, 144, 230.11

[56] References Cited

U.S. PATENT DOCUMENTS

| | | | |
|---|---|---|---|
| 2,465,152 | 3/1949 | Ellison | 145/61 EA X |
| 2,982,010 | 5/1961 | Johns | 15/230.11 X |
| 3,134,590 | 5/1964 | Young | 272/122 X |
| 3,165,772 | 1/1965 | McGinley | 15/230.11 |
| 3,756,597 | 9/1973 | Monti | 272/123 |

FOREIGN PATENT DOCUMENTS

| | | | |
|---|---|---|---|
| 12843 | of 1912 | United Kingdom | 272/123 |

*Primary Examiner*—Richard J. Apley
*Assistant Examiner*—Chris Coppens
*Attorney, Agent, or Firm*—Karl F. Ross; Herbert Dubno

[57] ABSTRACT

A barbell has a pair of tube sections mounted on opposite axial ends of the bar and provided with elastic sleeves which permit relative rotation of the bar and the tube sections but, together with spring rings or shoulders, axially fix the tube sections on the bar.

5 Claims, 6 Drawing Figures

ROTATABLE HANDHOLD FOR ATHLETIC EQUIPMENT ESPECIALLY FOR BARBELLS

FIELD OF THE INVENTION

My present invention relates to a handhold for sports and athletic equipment and, more particularly, to a grip for a weightlifting bar, especially a barbell. The invention also relates to barbells provided with such handholds.

BACKGROUND OF THE INVENTION

For a variety of sports and athletic purposes, handles, grips or handholds can be mounted upon a bar, shaft or rod so that they are rotatable but axially fixed relative to the bar. These handles are generally tubular and can be provided upon a weightlifting bar to flank the permanently placed, removable or adjustable disk-shaped weights. Rotation of the handle relative to the bar and the weights is important so that the weightlifter can properly grip the device and move the latter through all of the conventional weightlifting positions without excessive strain on the wrists or the hands which might ensue if the free rotation of the handle on the bar was not permitted.

In an earlier barbell, the tubular members were axially fixed to the ends of the weightlifting bar by thrusting the corresponding tube section inwardly over the end of the bar and locking it in place by a setting ring. The various methods of fixing the tube section axially included welding such ring to the stepped end of the bar, the ring having an outer diameter greater than the diameter of the bar and in such relationship to the bore of the tube section that the latter can overhang this ring and can be held in place by a cover which can be welded thereto.

This arrangement provides a permanent axial positioning of the tube section but has the disadvantage that fabrication is time-consuming and costly. Another disadvantage of this arrangement is that the portions of the tube section which engage the bar directly can wear away the bar during use and with relative rotation of the tube section and the bar.

Such damage to the bar may increase the tendency of the bar to bend at the regions at which wear ensues or may result in the tube catching on the bar so that free rotation is impeded.

In the latter case proper weightlifting procedures cannot be followed and part of the power of the weightlifter may be unused while, in the earlier case, there is a danger that the bending may render the entire apparatus useless.

OBJECTS OF THE INVENTION

It is the principal object of the present invention to provide an improved handhold for sports and athletic purposes whereby the aforementioned disadvantages are obviated.

Another object of this invention is to provide a weightlifting bar which has sleeves that can be effectively secured against axial displacement, are free to rotate on the bar and nevertheless can do no damage to the bar or have their rotation capability impeded by a direct interaction of a handle tube with the bar.

SUMMARY OF THE INVENTION

These objects and others which will become apparent hereinafter are attained, in accordance with the present invention, in a handle for sports and athletic purposes and especially for weightlifting bars which comprises a metal tube section adapted to be placed over the end of the bar of another shaft, a pair of elastic bearing sleeves, preferably composed of a synthetic resin material, interposed between the sleeves and the bar, and means for axially fixing at least the sleeve at the exterior of the bar to the tube section and the bar. The latter means can include step formations of the tube section and/or bar or shoulders formed in some other way, e.g. by split spring rings which engage in grooves in the tube section and/or in the bar or shaft. Such spring rings are variously known as snap rings, circlips and Seger rings and are characterized by an inward or outward elastic bias so that they can resiliently engage in an outwardly open circumferential groove or inwardly open circumferential groove, respectively, while projecting respectively out of or inwardly of this groove to form shoulders engaging the elastomeric sleeve.

The elastic sleeves of the present invention provide sufficient damping and given that bending of the bar is avoided and also form, at least in part, bearings enabling free rotation of the sleeve without wear of the sleeve or of the bar.

The elastomeric sleeves can have a low coefficient of friction or can be provided with low friction coverings or, if desired, even roller (e.g. needle) bearings. When such bearings are not provided, the elastic sleeves can be composed of polytetrafluoroethylene, rubber impregnated with molybdenum disulfide or like low friction materials. The elasticity of the bearing sleeves also precludes damage to the surface of the bar.

While handles of this construction have long useful lives and can be replaced inexpensively, an especially important advantage is the fact that their fabrication is inexpensive.

The system which is utilized to axially secure the tube section on the bar or shaft will generally depend upon the clearance between the tube section and the shaft, i.e. the difference in the internal diameter of the tube section and the outer diameter of the shaft. Thus, it is possible to provide steps or shoulders unitarily formed in the sleeve or on the shaft, e.g. by turning on a lathe in addition to use of spring rings of the aforedescribed type. In this case, the spring rings are preferably utilized as the axial retainers at the outermost ends of the sleeve end of the shaft exclusively.

When larger clearances are provided, such spring rings can also be provided internally of the outermost bearing sleeve, i.e. between the outermost bearing sleeve and the innermost bearing sleeve. Naturally, the use of spring rings is preferred since the grooves involved can be made by simpler turning procedures than the stepped shoulders.

According to another feature of the invention, the inner sleeve, i.e. the sleeve turned toward the weights, can be extended out of the tubed section and turned back over this section and preferably over an end flange of the latter to provide a layer of the bearing-sleeve material which forms a cushion protecting the hand of the user while also improving the appearance of the handle.

It has been found to be most advantageous, aesthetically and structurally when the ends of the two handles turned toward one another, i.e. inwardly, are tapered slightly outwardly, i.e. are beveled away from one another.

According to another feature of the invention, at least the outermost bearing sleeve is pressfitted into the tube section and is journaled on the bar by a rolling element, e.g. a ball bearing or needle bearing. This can improve the rotational characteristics of a handle without materially increasing the cost.

To prevent lateral play of the tube section upon the bar and to permit the axial forces to be absorbed effectively by the elastic sleeves, it is advantageous to provide force-distributing and/or yielding elements between the sleeve and the axial fixing means. Such elements can include simple washers or dished disk springs which absorb part of the axial force.

In the latter case, the space between the axial fitting members for the outermost bearing sleeve is greater than the axial width of this sleeve and between the sleeve and the fixing members dished-disk springs or other axially effective springs are provided, preferably under a light prestress.

The resulting contribution to the elasticity in the axial direction appears to avoid wear as well when the weights are changed or added to. The circumferential elasticity is present in all embodiments and is important to the life achieved with the handle of the instant invention.

BRIEF DESCRIPTION OF THE DRAWING

The above and other objects, features and advantages will become more readily apparent from the following description, reference being made to the accompanying drawing in which.

SPECIFIC DESCRIPTION

In the discussion below, reference is made to inner and outer elastic bearing sleeves, this distinction being made, respectively, between the bearing sleeve proximal to the weights and the bearing sleeve remote from the weights, i.e. the bearing sleeve proximal to the end of the bar. Furthermore, the handle of the invention is described in connection with barbells and like weightlifting gear, although it has application to other sports, athletic and training equipment or apparatus whenever force transmission between a handle or bar or shaft is desired and relative rotation of the handle and the shaft must occur. Such apparatus can include training machines and excercisers.

Finally, in this general discussion, reference is made to elastic sleeves. Such sleeves can be composed of any elastic or elastomeric synthetic resin material having shape-retentive properties under compression stress and capable of yielding without plastic deformation. The materials previously mentioned are preferred, but it should be noted that, in the sense of the invention, relatively hard synthetic resin materials such as nylon can be used for bearing sleeves as well.

Figure 1:
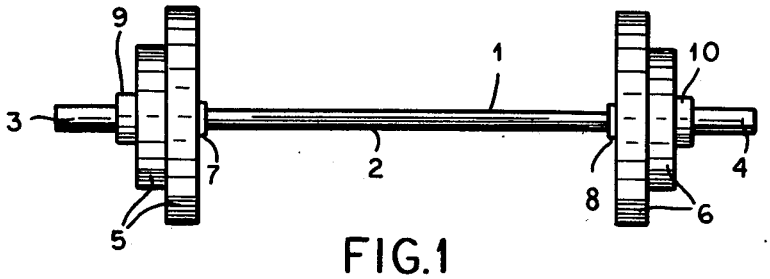
FIG. 1 is an elevational view of a weightlifting bar provided with handles in accordance with the present invention.

In FIG. 1, I have shown a barbell 1 which comprises the usual bar 2, the ends of which are fitted with tubed sections which can form handles or merely bar-terminating members as previously described, these members being represented at 3 and 4 and having the configuration of one or more of the embodiments illustrated in FIGS. 2 through 5.

The weight disks 5 and 6 are secured between collars 7,9 and 8, 10 which may be fixed adjustably along the bar, can be held in place by set screws or are otherwise positioned by means conventional in the barbell field.

Figure 2:
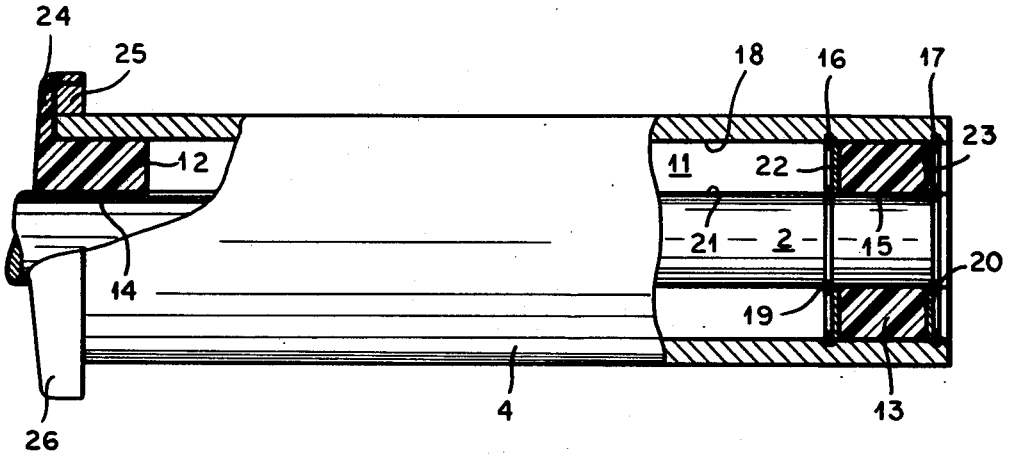
FIG. 2 is an elevational view partly broken away and in an axial section illustrating a first embodiment of the invention.

The tube sections 3 and 4, e.g. as shown for the tube section 4 in FIG. 2, can be fitted onto the ends of the bar 2 with a comparatively large clearance 11 such that elastomeric bearing sleeves 12 and 13 pressfitted into the tube section 4, are interposed between the tube section and the bar 2. The inner peripherie 14 and 15 of these sleeves are rotatable upon the outer surface of the bar 2. To prevent relative axial displacement of parts 2 and 4, the outer sleeve 13 is fixed between spring rings 16 and 17 in the tube section 4, these rings being fitted into respective grooves flanking the bearing sleeve.

Additional spring rings 19 and 20 are engaged in grooves formed in the bar to flank the sleeve 15, these grooves being recessed in the outer surface 21 of the bar or the inner surface 18 of the tube section.

To maintain a certain axial play and to distribute the axial forces effectively shams or washers 22 and 23 are interposed between the spring rings and the end faces of the sleeves 15.

The sleeve 12 is formed with an outwardly extending flange 24 which extends over a ring 25 welded to the tube section 4 and is provided with an outward frustoconical convergence or bevel as shown at 26. This arrangement in which the material of sleeve 12 envelops the flange at the inner end of the tube section can be provided for the tube sections of FIGS. 4 and 5 as well.

Figure 3:
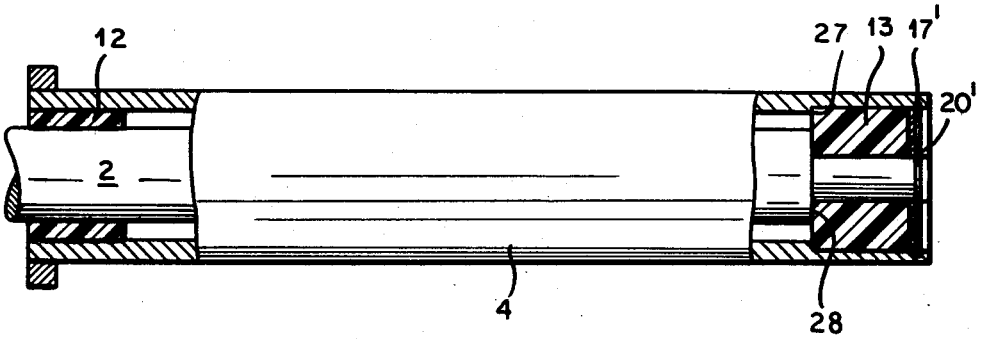
FIG. 3 is a similar view of another embodiment.

As can be seen from FIG. 3, when the space between the bar 2 and the tube section 4 is narrowed so that a relatively thin sleeve 12 is provided at the inner end, it is advantageous to turn down a step 28 at the outer end of the bar to accommodate the bearing sleeve 13. In this case the shoulder formed by the step serves as one axial abutment for the sleeve 13, together with a shoulder 27 turned in the tube section. Spring rings 20' and 17' engage the sleeve 13 at its opposite end. Internal spring rings are not necessary in this embodiment.

Figure 4:
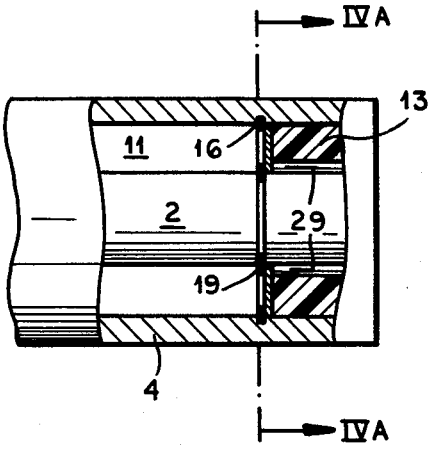
FIG. 4 is a detail view of the end elastic sleeve and its axial fixing means illustrating its use in conjunction with a needle bearing.
Figure 4A:
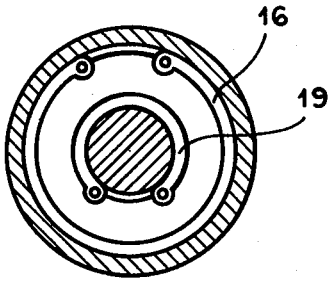
FIG. 4A is a section taken along the line IVA—IVA of FIG. 4.

FIGS. 4 and 4A show that the bearing sleeve 13 can engage the bar 2 via a needle bearing 29 and apart from this difference, the embodiment of FIG. 4 corresponds to that of FIG. 2.

Figure 5:
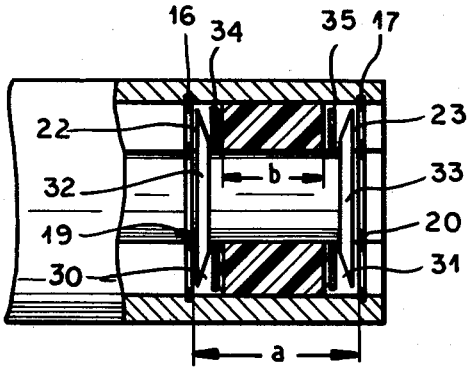
FIG. 5 is a view similar to FIG. 4 illustrating another embodiment of the invention provided with additional axially effective spring means.

In the arrangement of FIG. 5, the distance a between the fixing machines 16, 19 on the one hand and 17, 20 on the other, is greater than the axial width b of the sleeve 13 and in the spaces 30 and 31 between the sleeves and these fixing machines dish-disk springs (Belleville washers) 32, 33 are provided together with force distributing planar washers 34, 35. These elements have been shown somewhat more spread apart than is actually used for clarity. In practice the Belleville washers are under slight axial compression and contribute to the axial elasticity of the sleeve 13.

I claim:

1. A barbell comprising:

a weight-carrying bar; and respective tube sections fitted over opposite extremities of said bar and rotatable relative thereto, each tube section surrounding the respective bar extremity with clearance and having a pair of elastic sleeves in said clearance interposed between the tube section and the bar, means for axially fixing said tube section, said bar and at least one of said sleeves to limit relative axial displacement of each tube section and said bar while permitting relative rotation of the tube sections and the bar, and an integral portion of at least one sleeve of each tube section extending outwardly therefrom and over a flange formed by a ring welded on the tube section.

2. The barbell defined in claim 1 wherein the portion of the inner sleeve extending over said flange diverges frustoconically outwardly.

3. A barbell comprising:

a weight carrying bar; and respective tube sections fitted over opposite extremities of said bar and rotatable relative thereto, each tube section surrounding the respective bar extremity with clearance and having a pair of elastic sleeves in said clearance interposed between the tube section and the bar, means for axially fixing said tube section, said bar and at least one of said sleeves to limit relative axial displacement of each tube section and said bar while permitting relative rotation of the tube sections and the bar, said means for axially fixing said one of said sleeves of each tube section includes respective grooves formed in the tube section and the bar, respective spring rings received in said grooves and forming shoulders in said clearance, and an axially effective spring between said one of said sleeves and said spring rings.

4. The barbell defined in claim 3, further comprising a washer between said one of said sleeves and the respective spring rings.

5. The barbell defined in claim 3 wherein said axially effective spring is a Belleville washer.

* * * * *